US007516626B2

(12) United States Patent
Brox et al.

(10) Patent No.: US 7,516,626 B2
(45) Date of Patent: Apr. 14, 2009

(54) APPARATUS FOR THE LOW-TEMPERATURE SEPARATION OF A GAS MIXTURE, IN PARTICULAR AIR

(75) Inventors: Andreas Brox, Geretsried (DE); Markus Huppenberger, Bichl (DE)

(73) Assignee: Linde Aktiengesellschaft, Wiesbaden (DE)

( * ) Notice: Subject to any disclaimer, the term of this patent is extended or adjusted under 35 U.S.C. 154(b) by 358 days.

(21) Appl. No.: 11/292,282

(22) Filed: Dec. 2, 2005

(65) Prior Publication Data

US 2006/0156759 A1 Jul. 20, 2006

(30) Foreign Application Priority Data

Dec. 3, 2004 (EP) ..... 04028681
Dec. 3, 2004 (EP) ..... 04028682
Dec. 3, 2004 (EP) ..... 04028683

(51) Int. Cl.
*F25J 3/00* (2006.01)

(52) U.S. Cl. ..... 62/643; 62/620; 62/903

(58) Field of Classification Search ..... 62/643, 62/902, 620

See application file for complete search history.

(56) References Cited

U.S. PATENT DOCUMENTS 5,412,954 A 5/1995 Grenier
5,461,871 A 10/1995 Bracque et al.
5,979,182 A * 11/1999 Goto et al. ..... 62/643
6,360,815 B1 3/2002 Vadrot et al.
6,581,411 B2 * 6/2003 Massimo et al. ..... 62/643
6,945,076 B1 * 9/2005 Garnier et al. ..... 62/643
2004/0050095 A1 3/2004 Brigham et al.

FOREIGN PATENT DOCUMENTS

DE 2822774 11/1979
FR 2780147 12/1999
FR 2844344 3/2004

OTHER PUBLICATIONS

Publication BOC Cryoplants, "Oxygen-Nitrogen Generators," BOC Cryoplants Engineering Center, Guildford, GB, May 1992, pp. 1-5, XP001223905, the whole document.
Publication BOC Cryoplants, "Skid-mounted Oxygen-Nitrogen Plant Type SK145," BOC Cryoplants Engineering Center, Guildford, GB, Sep. 1991, pp. 1-3, XP001223907, the whole document.
Schmuecker B., "Projektspezifische Optimierung Von Anlagenkonzepten Bei Der Luftzerlegung," Berichte Aus Technik Und Wissenschaft, Linde AG, Wiesbaden, DE, 2000, pp. 27-31, vol. 80, XP001204721, ISSN:0942-332X.

* cited by examiner

*Primary Examiner*—William C Doerrler
(74) *Attorney, Agent, or Firm*—Millen, White, Zelano, Branigan, P.C.

(57) ABSTRACT

The apparatus is used to produce a product by low-temperature separation of a gas mixture, in particular air. It includes a direct contact cooler (3) for cooling the feed mixture, a purification apparatus (4) for purifying the cooled feed mixture and a low-temperature part (7). The low-temperature part (7) includes a main heat exchanger (8*a*) for cooling the purified feed mixture to approximately dewpoint temperature and a distillation column (9*a*) for low-temperature separation of the feed mixture. The direct contact cooler (3), the purification apparatus (4) and the low-temperature part (7) are arranged on one line (101).

27 Claims, 1 Drawing Sheet

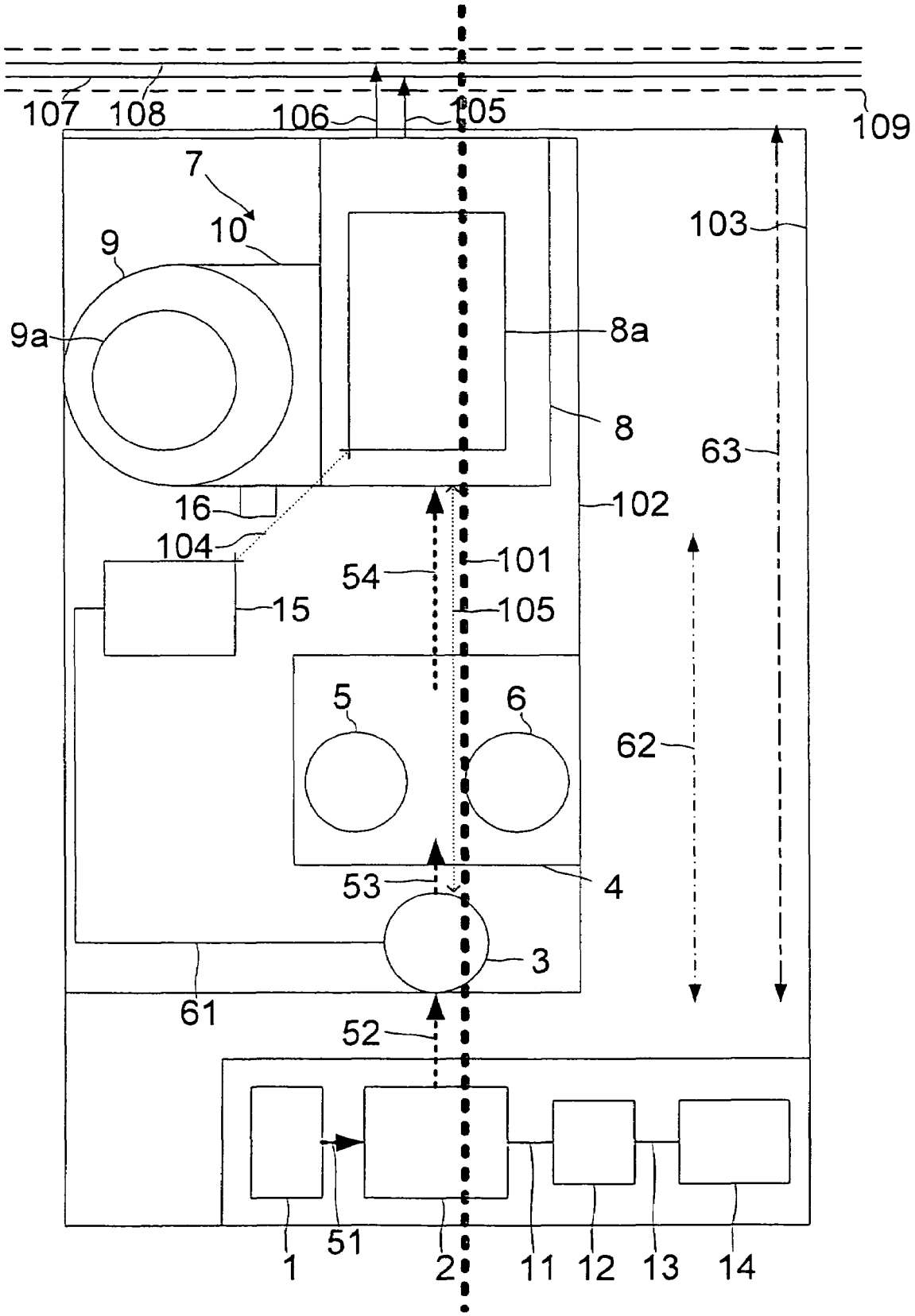
107
108
106
105
109
7
10
9
9a
8a
8
103
63
16
104
102
54
101
105
15
5
6
62
53
4
3
61
52
1
51
2
11
12
13
14

APPARATUS FOR THE LOW-TEMPERATURE SEPARATION OF A GAS MIXTURE, IN PARTICULAR AIR

The invention relates to an apparatus for producing a product by low-temperature separation of a gas mixture, in particular air, having a direct contact cooler for cooling the feed mixture, having a purification apparatus for purifying the cooled feed mixture, and having a low-temperature part, which includes a main heat exchanger for cooling the purified feed mixture to approximately dewpoint temperature and a distillation column for low-temperature separation of the feed mixture.

Apparatuses for the low-temperature separation of air or other gas mixtures are known, for example, from Hausen/Linde, Tieftemperaturtechnik, [Cryogenic Engineering], 2nd Edition, 1985.

In the present context, the term "low-temperature" is in principle to be understood as meaning any temperature which is below ambient temperature, but preferably a temperature of 200 K or less, most preferably 150 K or less, for example 100 K or less.

In a "direct contact cooler", the feed mixture is brought into direct heat exchange with a coolant, for example water, and thereby cooled. It is used in particular to dissipate heat of compression which has been produced in a feed gas compressor, generally connected upstream.

A subsequent "purification device" is generally designed as an adsorption apparatus and in particular has at least two reversible vessels which are operated cyclically. It is used to separate off undesired components, for example those which can freeze in the low-temperature part.

In the "low-temperature part", the feed mixture is initially cooled to approximately dewpoint temperature and then fractionated in a distillation column system. The low-temperature part therefore includes one or more heat exchangers and one or more distillation columns. The product is extracted in gas or liquid form from the low-temperature part. Of course, it is also possible to produce a plurality of products in the same or different state of aggregation and in the same or different chemical composition. To prevent losses caused by ambient heat flowing in, the low-temperature part is usually thermally insulated by being enclosed by one or more coldboxes.

The "main heat exchanger" is used to warm the gaseous product(s) in indirect heat exchange with at least one feed mixture stream.

The three installation components mentioned are usually arranged in such a way that the base area which they take up is as small as possible. This is not satisfactory in all cases.

Therefore, the invention is based on the object of further optimizing the arrangement of the components of a low-temperature separation unit in order to make the unit particularly economical.

This object is achieved by virtue of the fact that the direct contact cooler, the purification apparatus and the low-temperature part are arranged on one line.

The arrangement "on one line" means that there must be at least one horizontal straight line which intercepts the base areas of all three installation components mentioned. In the present context, the term "base area" is to be understood as meaning the standing surface area which is required for the corresponding installation components including the directly associated functional units, such as for example pumps and fittings.

An arrangement of this type is of course—contrary to previous practice—not optimum with regard to the utilization of the base area of the installation as a whole, since the base areas of the three components are of different sizes. (In general, direct contact cooler and purification device take up less space than the low-temperature part. However, in the context of the invention it has emerged that this drawback is more than compensated for by significant advantages.

The arrangement in one line minimizes in particular the outlay involved in flow-connecting the components of the installation to one another. The corresponding pipe lengths and the size of the associated steel structures, such as for example pipe bridges, are minimized. This means—in particular in the case of very large installations with a feed gas throughput of, for example, 50 000 $m^3/h$ (s.t.p.) or more, in particular 300 000 $m^3/h$ (s.t.p.) or more—a noticeable reduction in investment costs.

Moreover, the linear arrangement has the advantage that the components of the installation are in principle accessible from both sides for installation and maintenance work. This reduces the operating and repair costs of the installation.

A feed gas compressor for compressing the feed mixture is usually connected upstream of the direct contact cooler. In the context of the invention, this may, for example, be arranged laterally next to the group made up of direct contact cooler, purification apparatus and low-temperature part. However, it is particularly expedient if the feed gas compressor, the direct contact cooler, the purification apparatus and the low-temperature part are arranged on one line. This further boosts the abovementioned advantages.

The linear arrangement of all four components of the installation is advantageous in particular in the case of multi-train units in which a plurality of the apparatuses (trains) according to the invention are arranged next to one another. In this case, different connecting devices may be arranged at the ends of the individual trains, for example a pipe bridge for discharging the products on the side of the low-temperature part and/or a gas or steam turbine for driving the feed gas compressor with associated accessories, such as for example an air condenser, steam, gas and/or cooling water lines for machines or the like, on the compressor side. Nevertheless, the various components of the installation remain readily accessible.

The drive shaft of the feed gas compressor in this case in particular preferably runs substantially perpendicular to the line on which the direct contact cooler, the purification apparatus and the low-temperature part are arranged.

Alternatively, the feed gas compressor may be arranged laterally next to the remaining parts of the installation. In this case, in particular the drive shaft of the feed gas compressor runs substantially parallel to the line on which the direct contact cooler, the purification apparatus and the low-temperature part are arranged.

Moreover, in particular in the case of multi-train installations, it is expedient if the base area of the abovementioned installation components is relatively elongate in form. More specifically, in this case the ratio of the extent of the smallest rectangle which encloses the base areas of the direct contact cooler, the purification apparatus and the low-temperature part and if appropriate the feed gas compressor, in the direction of a connecting straight line between direct contact cooler and low-temperature part to the extent in the direction perpendicular to the first direction is greater than 1, in particular greater than 1.5. By way of example, this ratio is 2.0 or more, in particular 3.0 or more.

A plurality of apparatuses of this type can then be arranged longitudinally next to one another in order to form the multi-train installation. The apparatus for connecting the individual installations to one another (for example a pipe bridge for product lines) is arranged along the narrow sides and can therefore be made relatively short and inexpensive.

The feature that the ratio of the extent of the smallest rectangle (102; 103) which encloses the base areas of the direct contact cooler (3), the purification apparatus (4) and the low-temperature part (7) and if appropriate the feed gas compressor (2) in the direction of a connecting straight line (101) between direct contact cooler (3) and low-temperature part (7) to the extent in the direction perpendicular to the first direction is greater than 1, in particular greater than 1.8, namely the somewhat elongate base area of the individual installation, can in principle also be realized in apparatuses which do not comply with the features of the apparatus as generally described above.

The low-temperature part generally includes a heat exchanger box, which contains at least one main heat exchanger, a rectification box, which contains at least one distillation column, and an expansion machine arranged within a turbine casing. It is expedient if the turbine casing is arranged at a transition section of the low-temperature part which is located between the heat exchanger box and the rectification box. Alternatively, the turbine casing may be connected directly to the heat exchanger box.

The feature that the low-temperature part (7) includes a heat exchanger box (8), which contains at least one main heat exchanger, a rectification box (9), which contains at least one distillation column, a transition section (10), which is arranged between the heat exchanger box (8) and rectification box (9), and a turbine casing (16), which contains an expansion machine, the turbine casing (16) being connected to the transition section (10), namely arranging an expansion machine at the transition section between the heat exchanger box and the rectification box, can in principle also be realized in apparatuses which do not comply with the features of the apparatus as generally described above.

Further advantageous configurations of the apparatus according to the invention include:

- having a feed mixture line (51, 52, 53, 54) for introducing feed mixture into the main heat exchanger and having a product line (105, 106) for extracting the product stream from the main heat exchanger, characterized in that the feed mixture line (54) and the product line (104, 105) run substantially parallel to a main orientation axis (101) and are arranged on opposite sides of the main heat exchanger;
- including a collection line (107, 108) into which the product line (104, 105) opens out at its end remote from the main heat exchanger, the collection line (107, 108) running substantially perpendicular to the main orientation axis (101);
- the collection line (107, 108) being arranged on a pipe bridge (109) or on the ground;
- the collection line being connected to a product line of one or more further low-temperature separation apparatuses;
- the collection line being connected to a storage tank for product; and
- the main heat exchanger (8*a*) being designed exclusively as a recuperative heat exchanger.

Their features, in an apparatus for producing a product by low-temperature separation of a gas mixture, in particular air, can also be used independently of the features of the apparatus as generally described above or in combination with these features.

The feed mixture line for introducing feed mixture into the main heat exchanger and the product line for extracting the product stream from the main heat exchanger in this case run substantially parallel to a main orientation axis and are arranged at opposite sides of the main heat exchanger.

The "main orientation axis" represents an abstract straight line which runs in the horizontal direction and is generally not physically embodied by components of the installation or any other actual device.

Two directions are "substantially parallel" if they form an angle of less than 20°, preferably less than 10°, most preferably less than 5°, with one another.

The arrangement of having a feed mixture line (51, 52, 53, 54) for introducing feed mixture into the main heat exchanger and having a product line (105, 106) for extracting the product stream from the main heat exchanger, characterized in that the feed mixture line (54) and the product line (104, 105) run substantially parallel to a main orientation axis (101) and are arranged on opposite sides of the main heat exchanger; offers the advantage that the devices for discharging the products, for example one or more collection lines, into which the product line(s) open(s) out, may be arranged on one side of the main heat exchanger, and the devices for pretreating the feed mixture may be arranged on the opposite side of the main heat exchanger. This allows very short pipeline lengths.

Arranging the feed mixture lines and product lines opposite one another in particular minimizes the outlay involved in flow-connecting the installation components to one another. The corresponding pipe lengths and the size of the associated steel structures, such as for example pipe bridges, are minimized. This means—in particular in the case of very large installations with a feed gas throughput of, for example, 50 000 $m^3$/h (s.t.p.) or more, in particular 300 000 $m^3$/h (s.t.p.) or more—a noticeable reduction in the investment costs.

The arrangement also has the advantage that the installation components are fundamentally accessible from both sides for assembly and repair work. This reduces the operating and repair costs of the installation.

Moreover, it is expedient if the apparatus includes a collection line into which the product line opens out at its end remote from the main heat exchanger and if the collection line runs substantially perpendicular to the main orientation axis.

A direction is "substantially perpendicular" to another direction if the corresponding straight lines include an angle of from 70° to 110°, preferably 80° to 100°, most preferably 85° to 95°.

One or more collection lines can connect the apparatus and possible further identical or similar apparatuses (trains) to form a multi-train installation and/or may lead to a tank farm and/or to an emergency supply apparatus.

The collection line(s) may be arranged on a pipe bridge or on the ground. In the latter case, the collection lines are generally laid on what are known as sleepers.

It is preferable for collection line(s) to be connected to a product line of one or more further low-temperature separation apparatuses.

As an alternative or in addition, the collection line(s) may be connected to a storage tank for product.

It is expedient if, in the apparatus according to the invention, the main heat exchanger is designed exclusively as a recuperative heat exchanger, i.e. as a non-reversible heat exchanger.

The following additional features:

- providing a coolant circuit (61) for delivering coolant for the direct contact cooler, the coolant circuit having an evaporative cooler (15) for cooling coolant in direct heat exchange with a gas stream from the low-temperature part, characterized in that the ratio of the distance between evaporative cooler (15) and direct contact cooler (3) to the distance (104) between evaporative cooler (15) and main heat exchanger (8*a*) is at least 0.5, in particular at least 1.0;

providing that the ratio of the distance between evaporative cooler (15) and direct contact cooler (3) to the distance (104) between evaporative cooler (15) and main heat exchanger (8*a*) is at least 2, in particular at least 4;

providing that the distance (104) between evaporative cooler (15) and main heat exchanger (8*a*) is at most 20 m, in particular at most 10 m; and providing that the distance between evaporative cooler and direct contact cooler (3) is at least 10 m, in particular at least 25 m;

give further advantageous configurations of the apparatus according to the invention. Their features, in an apparatus for producing a product by low-temperature separation of a gas mixture, in particular air, may also be used independently of the features of the apparatus as generally described above or in combination with these features.

If an evaporative cooler is used, it is expedient if the ratio of the distance between evaporative cooler and direct contact cooler to the distance between evaporative cooler and main heat exchanger is at least 0.5, in particular at least 1.0.

The evaporative cooler 15 is therefore arranged relatively close to the main heat exchanger. Although this entails higher outlay for the coolant piping, the line for the gas stream from the low-temperature part can be made particularly short. In the context of the invention, it has emerged that this arrangement overall leads to relatively low investment costs. In particular, the outlay on the pipelines and the associated steelwork costs is reduced. This is partially attributable to the very high cross section (for example 1 to 2 m) of the gas line to the evaporative cooler.

The invention and further details of the invention are explained in more detail below on the basis of an exemplary embodiment of an apparatus according to the invention which is diagrammatically depicted in the drawing; the apparatus is designed as a low-temperature air separation unit.

BRIEF DESCRIPTION OF ATTACHED FIG. 1

Atmospheric air as "feed mixture" is sucked in via an inlet filter 1 and passed via feed pipelines 51, 52, 53, 54 to further components of the installation. First of all, the filtered air 51 is compressed in a main air compressor, which in the example constitutes the "feed gas compressor". The compressed air 52 flows into a direct contact cooler 3, where it is cooled in direct heat exchange with cooling water that flows in via a cooling water pipe 61. The cooled air 53 is passed onwards into a purification device 4 which includes a pair of molecular sieve absorbers 5, 6. The purified air 54 flows onwards to the low-temperature part 7.

The low-temperature part may comprise a single coldbox, in which all the cryogenic equipment is arranged, in particular the heat exchanger(s) and the distillation column(s), or alternatively a multiplicity of separate coldboxes. In the example, there are two separate coldboxes. A cylindrical rectification box 9 contains the distillation columns 9*a*, in this case a double column with a high-pressure column and a low-pressure column and a main condenser arranged between them. The remaining cold parts, in particular the main heat exchanger 8*a*, are accommodated in a cuboidal heat exchanger box 8. The two coldboxes 8, 9 insulate the respective cold apparatus parts from ambient heat. A transition section 10 also forms part of the low-temperature part. It is likewise surrounded by a coldbox; alternatively, the pipelines and fittings located in the transition section 10 are thermally insulated by means of a correspondingly smaller coldbox.

The main heat exchanger is designed as an exclusively recuperative heat exchanger, i.e. not as a reversible heat exchanger (Revex). It comprises, for example, one block or a plurality of blocks which are flow-connected to one another. The block(s) are preferably designed as aluminum plate-type heat exchangers. Possible further heat exchangers, such as for example one or more supercooling countercurrent heat exchangers, may likewise be accommodated in the heat exchanger box; alternatively or in addition, one or more blocks of supercooling countercurrent heat exchangers may be arranged in the rectification box. The shape of the rectification box may differ from the exemplary embodiment; by way of example, it may be substantially cuboidal.

The main air compressor 2 is driven via a first shaft 11 by a drive means 12 which is designed as an electric motor or a gas or steam turbine. Moreover, in the example there is a post-compressor 14 for part of the purified air 54. The inlet of the post-compressor 14 is connected to the pipeline 54 for the purified air via booster air piping 62 which is only indicated in the drawing. The air which has been compressed further in the post-compressor 14 is passed via a further pipeline (not shown in the drawing) into the low-temperature part 7, in particular into the heat exchanger box 8. In the example, the post-compressor 14 is driven via a further shaft 13, likewise by the drive means 12. Alternatively, the post-compressor could be driven independently of the main air compressor, for example by a separate gas or steam turbine or by a separate electric motor.

The products of the low-temperature part 7 are discharged via product lines 105, 106 which are indicated in the drawing by way of example and in this case open out into collection lines 107 and 108, respectively. The collection lines 107, 108 are arranged on a pipe bridge (109) and can connect the apparatus and possible further identical or similar apparatuses (trains) to form a multi-train installation and/or lead to a tank farm and/or an emergency supply apparatus.

An evaporative cooler 15 is used to cool water before it is introduced into the direct contact cooler 3. In this evaporative cooler, dry residual nitrogen from the low-temperature part undergoes direct heat and mass transfer with cooling water that is to be cooled. Cold cooling water is passed to the direct contact cooler via the cooling water piping 61. Warm cooling water is returned directly or indirectly to the evaporative cooler. The humid nitrogen from the evaporative cooler escapes into the atmosphere.

The apparatus also has utility piping 63, the position of which is diagrammatically indicated in the drawing. The utility piping is used to transport steam, gas and/or cooling water and to dispose of condensate, cooling water, etc. It opens out into utility collection lines (not shown), which may be arranged on the pipe bridge 109. Utility and booster air piping 63, 62 may be arranged on the ground (on sleepers) or on one or more pipe bridges.

In the exemplary embodiment, the base areas of the direct contact cooler 3, the purification device 4 and the low-temperature part 7 are circular or rectangular or of a more complex shape. These base areas are arranged on one line, for example on a main orientation axis 101. In addition, this line 101 also runs through the base area of the main air compressor 2. This results in a particularly short feed gas piping 52, 53, 54. The product lines 105, 106 which are arranged opposite the entry of the feed line 54 are also of a particularly short length. They may even be so short that there is no need for them to have a dedicated pipe bridge.

The rectangle 102 which surrounds the base areas of direct contact cooler 3, purification device 4 and low-temperature part 7, is about a factor of 1.7 longer in the extent which runs vertically in the drawing than in the direction perpendicular thereto (horizontally in the drawing). A factor of approximately 1.8 applies to the rectangle 103 which also surrounds the base area of the main air compressor and the equipment connected to it. As a result, a short pipe bridge 109 and short collection lines 107, 108 are sufficient for the product discharge and the utility feed and discharge; this is advantageous in particular in the case of multi-train installations. (The drawing is also not necessarily to scale in this respect, on account of its diagrammatic nature.)

On account of their functional relationship, the direct contact cooler 3 and evaporative cooler 15 are usually arranged as a single unit or at least as directly adjacent units. In the exemplary embodiment, however, the evaporative cooler 15 is significantly closer to the low-temperature part than to the direct contact cooler. The distance 104 between the evaporative cooler 15 and the main heat exchanger 8*a* is approximately one fifth of the distance between the direct contact cooler 3 and the low-temperature part 7. As a result, the residual nitrogen line between the main heat exchanger and the evaporative cooler 15, which is not illustrated in the drawing, only has to cover a relatively short distance and can be therefore realized at particularly low cost; this saving is very important in view of the very large cross section of the residual nitrogen line. Although the cooling water piping is longer, its cross section is very much smaller, which means that the apparatus costs are increased only to an insignificant extent.

Low-temperature air separation units usually have one or more expansion machines which are used to generate refrigeration by work-performing expansion of one or more process streams and are usually designed as turbines. The installation shown in the exemplary embodiment preferably has a turbine for the work-performing expansion of a part-stream of the feed air or of a product or intermediate product stream from the low-temperature separation. This turbine is positioned in a turbine casing 16, which in the exemplary embodiment is arranged at the transition section 10 between heat exchanger box 8 and rectification box 9.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth uncorrected in degrees Celsius and, all parts and percentages are by weight, unless otherwise indicated.

The entire disclosures of all applications, patents and publications, cited herein and of corresponding European application No. 04028682.5, filed Dec. 3, 2004; European application No. 04028683.3, filed Dec. 3, 2004; and European application No. 04028681.7, filed Dec. 3, 2004 are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. Apparatus for producing a product by low-temperature separation of a gas mixture, having a direct contact cooler (3) for cooling the feed mixture, having a purification apparatus (4) in communication with the direct contact cooler for purifying the cooled feed mixture, and having a low-temperature part (7), which includes a main heat exchanger (8*a*) in communication with the purification apparatus for cooling the purified feed mixture to approximately its dewpoint temperature and a distillation column (9*a*) in communication with the main heat exchanger for low-temperature separation of the purified and cooled feed mixture, wherein the direct contact cooler (3), the purification apparatus (4) and the low-temperature part (7) are spatially arranged on one horizontal straight line (101).

2. Apparatus according to claim 1, further comprising a feed gas compressor (2), connected upstream of the direct contact cooler (3), for compressing the feed mixture, the feed gas compressor (2), the direct contact cooler (3), the purification apparatus (4) and the low-temperature part (7) being spatially arranged on one horizontal straight line (101).

3. Apparatus according to claim 1, further comprising a feed gas compressor (2), connected upstream of the direct contact cooler (3), for compressing the feed mixture, the drive shaft (11) of the feed gas compressor (2) running substantially perpendicular to the horizontal straight line (101) on which the direct contact cooler (3), the purification apparatus (4) and the low-temperature part (7) are spatially arranged.

4. Apparatus according to claim 1, further comprising a feed gas compressor (2), connected upstream of the direct contact cooler (3), for compressing the feed mixture, the drive shaft of the feed gas compressor (2) running substantially parallel to the horizontal straight line (101) on which the direct contact cooler (3), the purification apparatus (4) and the low-temperature part (7) are spatially arranged.

5. Apparatus according to claim 1, wherein the ratio of the extent of the smallest rectangle (102; 103) which encloses the base areas of the direct contact cooler (3), the purification apparatus (4) and the low-temperature part (7) in the direction of a connecting straight line (101) between direct contact cooler (3) and low-temperature part (7) to the extent in the direction perpendicular to the first direction is greater than 1.

6. Apparatus according to claim 1, wherein the low-temperature part (7) includes a heat exchanger box (8), which contains at least one main heat exchanger, a rectification box (9), which contains at least one distillation column, a transition section (10), which is arranged between the heat exchanger box (8) and rectification box (9), and a turbine casing (16), which contains an expansion machine, the turbine casing (16) being connected to the transition section (10).

7. Apparatus according to claim 1, further comprising a feed mixture line (51, 52, 53, 54) for introducing feed mixture into the main heat exchanger and a product line (105, 106) for extracting the product stream from the main heat exchanger, wherein the feed mixture line (54) and the product line (104, 105) run substantially parallel to a main orientation axis (101) and are arranged on opposite sides of the main heat exchanger.

8. Apparatus according to claim 7, further comprising a collection line (107, 108) into which the product line (104, 105) opens out at its end remote from the main heat exchanger, the collection line (107, 108) running substantially perpendicular to the main orientation axis (101).

9. Apparatus according to claim 8, wherein the collection line (107, 108) is arranged on a pipe bridge (109) or on the ground.

10. Apparatus according to claim 8, wherein the collection line is connected to a product line of one or more further low-temperature separation apparatuses.

11. Apparatus according to claim 8, wherein the collection line is connected to a storage tank for product.

12. Apparatus according to claim 7, wherein the main heat exchanger (8*a*) is designed exclusively as a recuperative heat exchanger.

13. Apparatus according to claim 1 further comprising a coolant circuit (61) for delivering coolant for the direct contact cooler, the coolant circuit having an evaporative cooler (15) for cooling coolant in direct heat exchange with a gas stream from the low-temperature part, wherein the ratio of the distance between evaporative cooler (15) and direct contact cooler (3) to the distance (104) between evaporative cooler (15) and main heat exchanger (8*a*) is at least 0.5.

14. Apparatus according to claim 13, wherein the ratio of the distance between evaporative cooler (15) and direct contact cooler (3) to the distance (104) between evaporative cooler (15) and main heat exchanger (8*a*) is at least 2.

15. Apparatus according to claim 13, wherein the distance (104) between evaporative cooler (15) and main heat exchanger (8*a*) is at most 20 m.

16. Apparatus according to claim 13, wherein the distance between evaporative cooler and direct contact cooler (3) is at least 10 m.

17. Apparatus according to claim 1, wherein the apparatus is for producing a product by low-temperature separation of air.

18. Apparatus according to claim 2, wherein the ratio of the extent of the smallest rectangle (102; 103) which encloses the base areas of the direct contact cooler (3), the purification apparatus (4), the low-temperature part (7) and the feed gas compressor (2), in the direction of a connecting straight line (101) between direct contact cooler (3) and low-temperature part (7) to the extent in the direction perpendicular to the first direction is greater than 1.

19. Apparatus according to claim 3, wherein the ratio of the extent of the smallest rectangle (102; 103) which encloses the base areas of the direct contact cooler (3), the purification apparatus (4), the low-temperature part (7) and the feed gas compressor (2), in the direction of a connecting straight line (101) between direct contact cooler (3) and low-temperature part (7) to the extent in the direction perpendicular to the first direction is greater than 1.

20. Apparatus according to claim 4, wherein the ratio of the extent of the smallest rectangle (102; 103) which encloses the base areas of the direct contact cooler (3), the purification apparatus (4), the low-temperature part (7) and the feed gas compressor (2), in the direction of a connecting straight line (101) between direct contact cooler (3) and low-temperature part (7) to the extent in the direction perpendicular to the first direction is greater than 1.

21. Apparatus according to claim 1, wherein the ratio of the extent of the smallest rectangle (102; 103) which encloses the base areas of the direct contact cooler (3), the purification apparatus (4) and the low-temperature part (7) in the direction of a connecting straight line (101) between direct contact cooler (3) and low-temperature part (7) to the extent in the direction perpendicular to the first direction is greater than 1.8.

22. Apparatus according to claim 1 further comprising a coolant circuit (61) for delivering coolant for the direct contact cooler, the coolant circuit having an evaporative cooler (15) for cooling coolant in direct heat exchange with a gas stream from the low-temperature part, wherein the ratio of the distance between evaporative cooler (15) and direct contact cooler (3) to the distance (104) between evaporative cooler (15) and main heat exchanger (8*a*) is at least 1.0.

23. Apparatus according to claim 13, wherein the ratio of the distance between evaporative cooler (15) and direct contact cooler (3) to the distance (104) between evaporative cooler (15) and main heat exchanger (8*a*) is at least 4.

24. Apparatus according to claim 13, wherein the distance (104) between evaporative cooler (15) and main heat exchanger (8*a*) is at most 10 m.

25. Apparatus according to claim 13, wherein the distance between evaporative cooler and direct contact cooler (3) is at least 25 m.

26. Apparatus according to claim 1, wherein the apparatus has a feed gas throughput of 50 000 $m^3$/h (s.t.p.) or more.

27. Apparatus according to claim 1, wherein the apparatus has a feed gas throughput of 300 000 $m^3$/h (s.t.p.) or more.

* * * * *